US010504439B2

(12) United States Patent
Xu et al.

(10) Patent No.: US 10,504,439 B2
(45) Date of Patent: Dec. 10, 2019

(54) OLED DISPLAY PANEL AND DRIVING METHOD USING DIFFERENTIAL DATA FOR VOLTAGE COMPENSATION

(71) Applicant: Shenzhen China Star Optoelectronics Semiconductor Display Technology Co., Ltd., Shenzhen (CN)

(72) Inventors: Jing Xu, Shenzhen (CN); Ming-jong Jou, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/572,502

(22) PCT Filed: Nov. 2, 2017

(86) PCT No.: PCT/CN2017/109101
§ 371 (c)(1),
(2) Date: Nov. 8, 2017

(87) PCT Pub. No.: WO2019/033579
PCT Pub. Date: Feb. 21, 2019

(65) Prior Publication Data

US 2019/0057654 A1 Feb. 21, 2019

(30) Foreign Application Priority Data

Aug. 18, 2017 (CN) ..... 2017 1 0711159

(51) Int. Cl.
*G09G 3/30* (2006.01)
*G09G 3/3258* (2016.01)

(52) U.S. Cl.
CPC ..... *G09G 3/3258* (2013.01); *G09G 2310/08* (2013.01); *G09G 2320/0295* (2013.01); *G09G 2320/045* (2013.01); *G09G 2370/045* (2013.01); *G09G 2370/14* (2013.01)

(58) Field of Classification Search
CPC ..... G09G 3/325; G09G 3/3258
USPC ..... 345/76
See application file for complete search history.

(56) References Cited

U.S. PATENT DOCUMENTS

2008/0170036 A1 7/2008 Chen
2012/0200542 A1 8/2012 Hong et al.
2014/0184574 A1 7/2014 Shie et al.
(Continued)

FOREIGN PATENT DOCUMENTS

CN 101365130 2/2009
CN 101477779 7/2009
(Continued)

*Primary Examiner* — Adam J Snyder

(57) ABSTRACT

The present disclosure provides an OLED display panel and a driving method for the OLED display panel. The display panel comprises a first data converter configured to encode voltage data into parallel transmission data, the number of data bits of the transmission data being greater than that of the voltage data; a second data converter configured to convert the transmission data into serial relay data; a transmitter configured to convert the relay data into differential data and send the differential data; and a timing controller configured to receive the differential data and clock information in the differential data, and perform voltage compensation.

12 Claims, 5 Drawing Sheets

(56) References Cited

U.S. PATENT DOCUMENTS

| | | | | |
|---|---|---|---|---|
| 2015/0179107 | A1* | 6/2015 | Kim | G09G 3/3233 345/212 |
| 2015/0379937 | A1* | 12/2015 | Kim | G09G 3/006 345/691 |
| 2016/0063910 | A1* | 3/2016 | An | G09G 3/3233 345/691 |
| 2016/0189321 | A1 | 6/2016 | Halpern et al. | |
| 2016/0189595 | A1* | 6/2016 | Choi | G09G 2/2092 345/212 |
| 2016/0189621 | A1* | 6/2016 | Kim | G09G 3/3258 345/215 |
| 2017/0124949 | A1* | 5/2017 | Lee | G09G 3/3233 |
| 2017/0193877 | A1* | 7/2017 | Lee | G09G 3/2003 |
| 2018/0006101 | A1* | 1/2018 | Ha | H01L 27/32 |
| 2018/0122294 | A1* | 5/2018 | Do | G09G 3/3225 |
| 2018/0204514 | A1 | 7/2018 | Xu et al. | |

FOREIGN PATENT DOCUMENTS

| | | |
|---|---|---|
| CN | 101894519 | 11/2010 |
| CN | 102104375 | 6/2011 |
| CN | 103166732 | 6/2013 |
| CN | 103166732 A * | 6/2013 |
| CN | 103903576 | 7/2014 |
| CN | 105513541 | 4/2016 |
| CN | 105741760 | 7/2016 |

* cited by examiner

OLED DISPLAY PANEL AND DRIVING METHOD USING DIFFERENTIAL DATA FOR VOLTAGE COMPENSATION

RELATED APPLICATIONS

This application is a National Phase of PCT Patent Application No. PCT/CN2017/109101 having International filing date of Nov. 2, 2017, which claims the benefit of priority of Chinese Patent Application No. 201710711159.8 filed on Aug. 18, 2017. The contents of the above applications are all incorporated by reference as if fully set forth herein in their entirety.

FIELD AND BACKGROUND OF THE INVENTION

The present disclosure relates to the technical field of display technology, and more particularly to an OLED display panel and a driving method for the OLED display panel.

Existing display panels mainly include liquid crystal display (LCD) panels and OLED (organic light emitting diode) display panels. OLED display panels have been regarded as the most promising display panels due to their advantages of self-illumination, low driving voltage, high luminous efficiency, short response time, high definition and contrast, a viewing angle of approximately 180 degrees, wide available temperature range, the capability of flexible display and large-area full-color display, and the like. With the improvement in processes and manufacturing procedures of OLED display panels and the reduced cost, OLED TV sets have become more widespread and have been gradually known and accepted by consumers.

However, the problem of quite low stability of device performance of OLED display panels has long been criticized. The device performance includes the threshold voltage of the OLED, the threshold voltage and mobility of the transistor, and the like. Due to the change and drift in device characteristics and the difference between devices, the characteristics of OLED display panels will become worse, thereby influencing the viewing effect. Therefore, those characteristics need to be compensated.

However, if the conventional serial electrical compensation is used, impedance mismatching, clock skew and other problems will be caused. Once the clock and the data are out of sync, transmission data errors will be caused. Consequently, the panel characteristics are not compensated and the display effect will even deteriorate.

SUMMARY OF THE INVENTION

An objective of the present disclosure is to provide an OLED display panel and a driving method for the OLED display panel, in order to solve the clock and the data being out-of-sync.

For this purpose, the OLED display panel provided by the present disclosure adopts the following technical solution:

An OLED display panel includes:

a sensing unit configured to acquire voltage data of an OLED of the display panel or voltage data of a driving thin-film transistor of a sub-pixel of the display panel;

a first data converter configured to encode the voltage data into parallel transmission data according to a preset encoding rule, the number of data bits of the transmission data being greater than that of the voltage data;

a second data converter configured to convert the transmission data into serial relay data;

a transmitter configured to convert the relay data into differential data and send the differential data to a timing controller;

the timing controller configured to receive the differential data and clock information in the differential data, and perform voltage compensation on a sub-pixel or an OLED according to the differential data;

a receiver configured to receive the differential data and convert the differential data into the relay data;

a clock data restorer configured to acquire the clock information from the relay data;

a third data converter configured to convert the relay data into the transmission data according to the clock information; and a fourth data converter configured to decode the transmission data into the voltage data according to the preset encoding rule, the number of data bits of the transmission data being greater than that of the voltage data; wherein the timing controller is further configured to receive the voltage data and perform voltage compensation on the sub-pixel or the OLED according to the voltage data;

wherein the sensing unit comprises a plurality of sensing units which are connected in a cascaded manner.

In the OLED display panel of the present disclosure, the sensing unit is an independent element.

In the OLED display panel of the present disclosure, the OLED display panel further comprises a source driving chip; and the sensing unit is integrated in the source driving chip.

In the OLED display panel of the present disclosure, the first data converter, the second data converter, and the transmitter are integrated in the sensing unit.

In the OLED display panel of the present disclosure, the first data converter, the second data converter, and the transmitter are independent elements.

In the OLED display panel of the present disclosure, the first data converter is an 8b/10b encoder.

An OLED display panel includes:

a sensing unit configured to acquire voltage data of an OLED of the display panel or voltage data of a driving thin-film transistor of a sub-pixel of the display panel;

a first data converter configured to encode the voltage data into parallel transmission data according to a preset encoding rule, the number of data bits of the transmission data being greater than that of the voltage data;

a second data converter configured to convert the transmission data into serial relay data;

a transmitter configured to convert the relay data into differential data and send the differential data to a timing controller;

the timing controller configured to receive the differential data and clock information in the differential data, and perform voltage compensation on a sub-pixel or an OLED according to the differential data.

In the OLED display panel of the present disclosure, the display panel further comprises:

a receiver configured to receive the differential data and convert the differential data into the relay data;

a clock data restorer configured to acquire the clock information from the relay data;

a third data converter configured to convert the relay data into the transmission data according to the clock information; and a fourth data converter configured to decode the transmission data into the voltage data according to the preset encoding rule, the number of data bits of the transmission data being greater than that of the voltage data; wherein the timing controller is further configured to receive the voltage data and perform voltage compensation on the sub-pixel or the OLED according to the voltage data.

In the OLED display panel of the present disclosure, the sensing unit is an independent element.

In the OLED display panel of the present disclosure, the OLED display panel further comprises a source driving chip; and the sensing unit is integrated in the source driving chip.

In the OLED display panel of the present disclosure, the sensing unit comprises a plurality of sensing units which are connected in a cascaded manner.

In the OLED display panel of the present disclosure, the first data converter, the second data converter, and the transmitter are integrated in the sensing unit.

In the OLED display panel of the present disclosure, the first data converter, the second data converter, and the transmitter are independent elements.

In the OLED display panel of the present disclosure, the first data converter is an 8b/10b encoder.

In order to solve the foregoing problem, the preferred embodiment of the present disclosure further provides a driving method for an OLED display panel. The driving method for an OLED display panel includes:

acquiring differential data sent by a sensing unit, the differential data comprising voltage data of a driving thin-film transistor of a sub-pixel or voltage data of an OLED;

converting the differential data into serial relay data;

acquiring clock information from the relay data;

converting the relay data into parallel transmission data according to the clock information;

decoding the transmission data into voltage data according to a preset encoding rule, the number of data bits of the transmission data being greater than that of the voltage data; and performing voltage compensation on the sub-pixel or the OLED according to the voltage data.

In the driving method for an OLED display panel of the present disclosure, before acquiring differential data sent by a sensing unit, the method further includes:

acquiring voltage data of the driving thin-film transistor of the sub-pixel or the voltage data of the OLED;

encoding the voltage data into parallel transmission data according to the preset encoding rule, the number of data bits of the transmission data being greater than that of the voltage data;

converting the transmission data into serial relay data;

converting the relay data into differential data; and separately sending the differential data to a timing controller.

In the driving method for an OLED display panel of the present disclosure, the preset encoding rule is an 8b/10b encoding rule.

In the driving method for an OLED display panel of the present disclosure, the transmission data comprise control characters, and the control characters include a starting identifier for controlling starting of transmission of the transmission data and an ending identifier for controlling ending of transmission of the transmission data.

In the driving method for an OLED display panel of the present disclosure, separately sending the differential data to a timing controller includes:

sending the differential data sequentially from low bits to high bits.

In the driving method for an OLED display panel of the present disclosure, the differential data are a highly noise resistant low-voltage differential signal and the relay data are a high-speed serial signal in a CMOS level.

Compared with the conventional technology, the advantage of the present disclosure is as follows: The voltage data acquired by the sensing unit is encoded, parallel-to-serial converted, and then converted into differential data which is then transmitted to the timing controller. The timing controller extracts voltage data and a clock signal from the differential data, and performs voltage compensation on the sub-pixel or the OLED according to the clock signal and the voltage data. When signals are to be transmitted to the timing controller, the transmission only requires the differential data and does not require the differential clock signal, which can eliminate the clock skew caused by impendence mismatching or the like. Thus, both accuracy of data transmission and stability of data transmission are improved.

To make the contents of the present disclosure more apparent and understandable, the present disclosure will be described below in detail by preferred embodiments with reference to the accompanying drawings.

BRIEF DESCRIPTION OF THE SEVERAL VIEWS OF THE DRAWINGS

The technical solution, as well as beneficial advantages, of the present disclosure will be apparent from the following detailed description of the specific embodiments of the present disclosure, with reference to the accompanying drawings.

DESCRIPTION OF SPECIFIC EMBODIMENTS OF THE INVENTION

Figure 1:
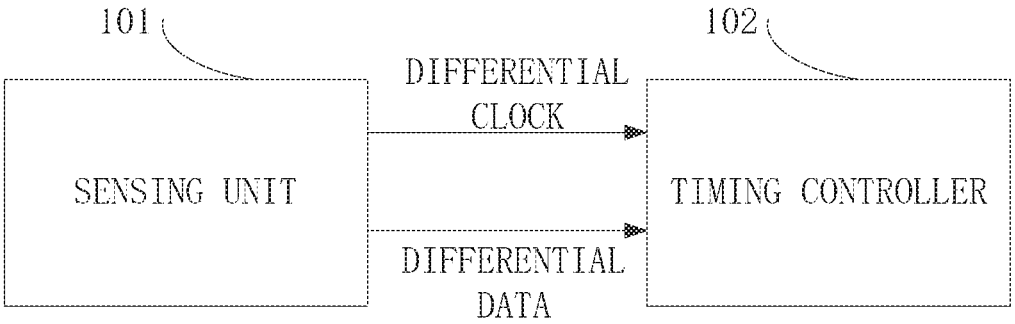
FIG. 1 PRIOR ART
FIG. 1 is a schematic view showing data transmission of a conventional sensing unit.

For better explaining the technical solution and the effect of the present disclosure, the present disclosure will be further described in detail with the accompanying drawings and the specific embodiments. The described embodiments are some but not all of the embodiments of the present disclosure. All other embodiments obtained by a person of ordinary skill in the art based on the embodiments of the present disclosure without creative efforts shall fall within the protection scope of the present disclosure.

In the drawings, similar structural units are designated by the same reference numerals.

An OLED display panel and a driving method for the OLED display panel according to an embodiment of the present disclosure will be described below with reference to FIG. 1 to FIG. 11.

Figure 2:
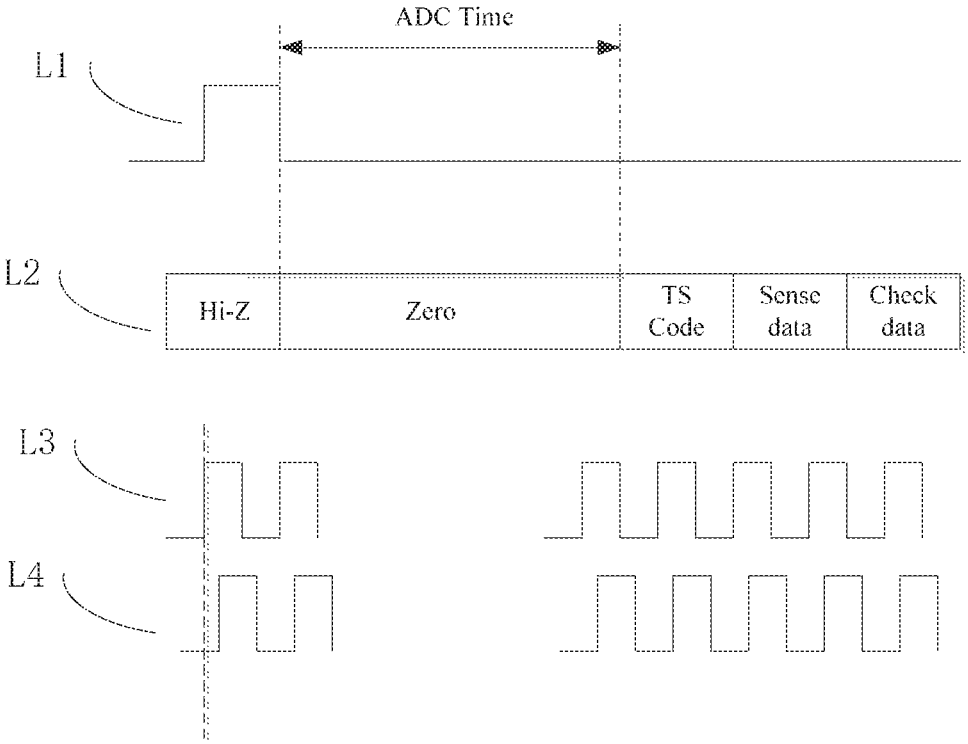
FIG. 2 PRIOR ART
FIG. 2 is a schematic view showing clock skew in the data transmission of the conventional sensing unit.
Figure 3:
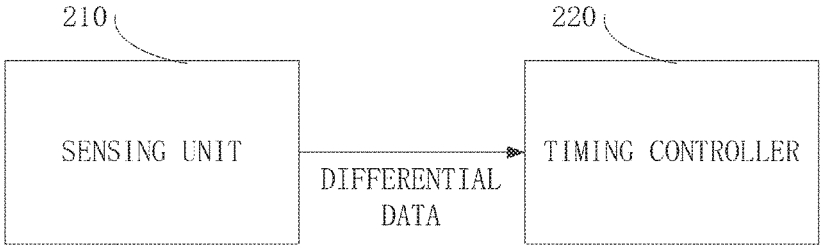
FIG. 3 is a schematic view showing data transmission of a sensing unit according to an embodiment of the present disclosure.
Figure 4:
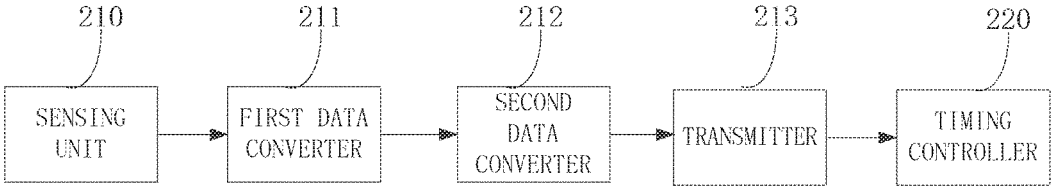
FIG. 4 is a block diagram of an OLED display panel according to an embodiment of the present disclosure.
Figure 5:
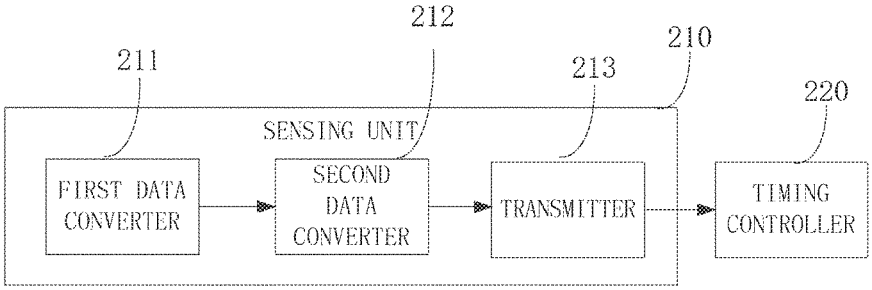
FIG. 5 is another block diagram of an OLED display panel according to an embodiment of the present disclosure.
Figure 6:
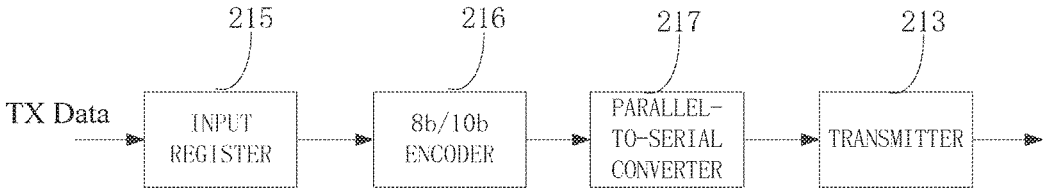
FIG. 6 is a schematic view showing a process of sending a signal by the OLED display panel according to an embodiment of the present disclosure.
Figure 7:
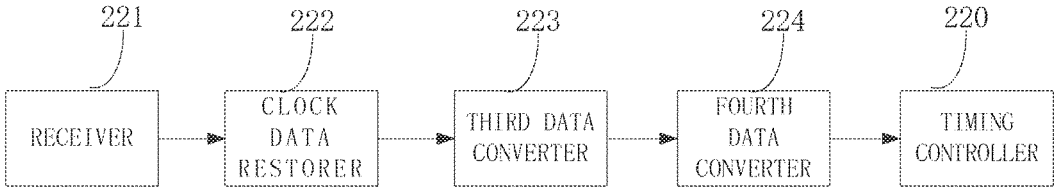
FIG. 7 is still another block diagram of an OLED display panel according to an embodiment of the present disclosure.
Figure 8:
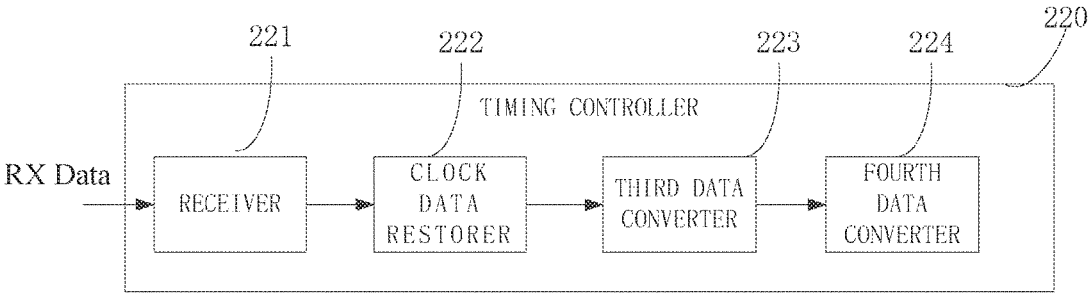
FIG. 8 is a schematic view of a process of receiving a signal by the OLED display panel according to an embodiment of the present disclosure.
Figure 9:
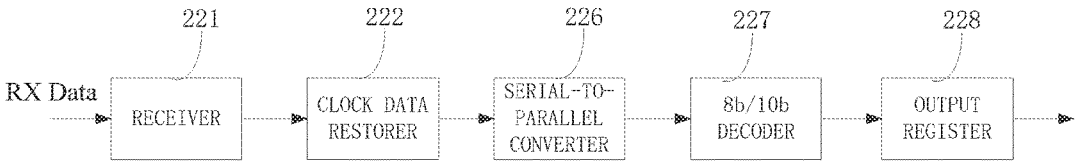
FIG. 9 is a schematic view showing another process of receiving a signal by the OLED display panel according to an embodiment of the present disclosure.
Figure 10:
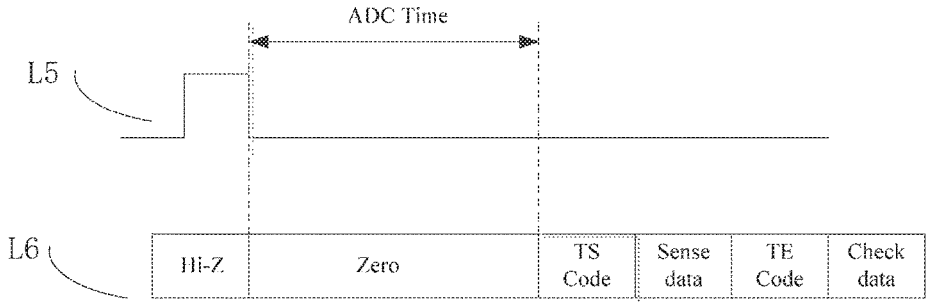
FIG. 10 is a schematic view of differential data according to an embodiment of the present disclosure.
Figure 11:
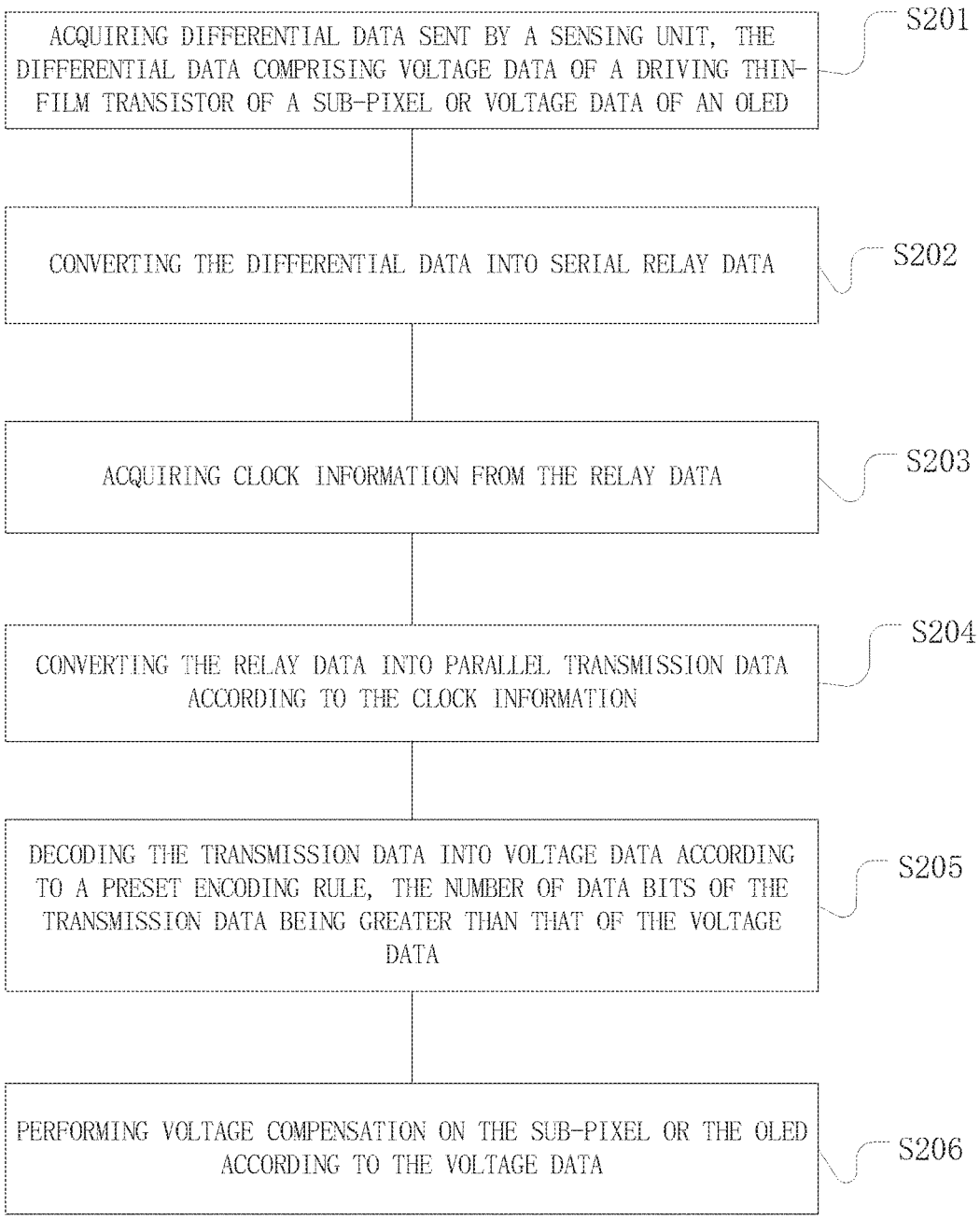
FIG. 11 is a flowchart of a driving method for the OLED display panel according to an embodiment of the present disclosure.

According to an embodiment of the present disclosure, as shown in FIG. 1 to FIG. 11, FIG. 1 is a schematic view showing data transmission of a conventional sensing unit; FIG. 2 is a schematic view showing clock skew in the data transmission of the conventional sensing unit; FIG. 3 is a schematic view showing data transmission of a sensing unit according to an embodiment of the present disclosure; FIG. 4 is a block diagram of an OLED display panel according to an embodiment of the present disclosure; FIG. 5 is another block diagram of an OLED display panel according to an embodiment of the present disclosure; FIG. 6 is a schematic view showing a process of sending a signal by the OLED display panel according to an embodiment of the present disclosure; FIG. 7 is still another block diagram of an OLED display panel according to an embodiment of the present disclosure; FIG. 8 is a schematic view of a process of receiving a signal by the OLED display panel according to an embodiment of the present disclosure; FIG. 9 is a schematic view showing another process of receiving a signal by the OLED display panel according to an embodiment of the present disclosure; FIG. 10 is a schematic view of differential data according to an embodiment of the present disclosure; and FIG. 11 is a flowchart of a driving method for the OLED display panel according to an embodiment of the present disclosure.

As one of the methods for solving the low stability of device performance of OLED display panels, electrical compensation is used. A sensing unit first senses a threshold voltage of a driving TFT of each sub-pixel or a threshold voltage of an OLED, and then feeds the sensed data back to a timing controller (TCON) which performs compensation on each sub-pixel by using the sensed data with a corresponding algorithm.

There are many ways of transmitting the sensed data back to the TCON from the sensing IC, including parallel transmission and serial transmission.

The parallel transmission will occupy many signal lines and thus increase the area of the IC, resulting in low resistance to interference, much noise introduced therebetween, and low transmission rate.

The serial transmission uses differential signals, and outside noise is loaded onto two differential lines used for parallel transmission and may be offset by subtraction, so that it is highly resistant to the outside noise. Furthermore, the serial transmission will occupy fewer signal lines, resulting in low self-interference and a high transmission rate.

As shown in FIG. 1, the serial transmission uses differential signals. A sensing unit 101 transmits differential data and a differential clock to a timing controller 102, respectively. However, as shown in FIG. 2, there may be impedance mismatching, clock skew, or other problems in this transmission. As shown, a curve L1 denotes a control signal, a curve L2 denotes differential data, a curve L3 denotes a clock on the transmitting side, and a curve L4 denotes a clock on the receiving side. As shown, the clock curve indicated by the curve L4 and the clock curve indicated by the curve L3 are out of sync. Once the clock and the data are out of sync, transmission errors will be caused. Consequently, characteristics of the display panel are not compensated and the display effect will even deteriorate.

As shown in FIG. 3 and FIG. 4, the embodiment provides an OLED display panel comprising a sensing unit 20, a first data converter 211, a second data converter 212, a transmitter 213, and a timing control chip 220.

The sensing unit 210 is configured to acquire voltage data of an OLED of the display panel or voltage data of a driving thin-film transistor of a sub-pixel of the display panel.

The first data converter 211 is configured to encode the voltage data into parallel transmission data according to a preset encoding rule, the number of data bits of the transmission data being greater than that of the voltage data.

The second data converter 212 is configured to convert the transmission data into serial relay data.

The transmitter 213 is configured to convert the relay data into differential data and send the differential data to the timing controller.

The timing controller 220 is configured to receive the differential data and clock information in the differential data, and perform voltage compensation on the sub-pixel or the OLED according to the differential data.

The voltage data acquired by the sensing unit 210 is encoded, parallel-to-serial converted, and then converted into differential data which is then transmitted to the timing controller 220. The timing controller 220 extracts voltage data and a clock signal from the differential data, and performs voltage compensation on the sub-pixel or the OLED according to the clock signal and the voltage data. When signals are to be transmitted to the timing controller 220, the transmission only requires the differential data and does not require the differential clock signal, which can eliminate the clock skew caused by impendence mismatching or the like. Thus, both accuracy of data transmission and stability of data transmission are improved.

As shown in FIG. 5, optionally, the first data converter 211, the second data converter 212, and the transmitter 213 may be integrated in the sensing unit 210. The first data converter 211, the second data converter 212, and the transmitter 213 may be arranged separately, or partially integrated together.

Specifically, as shown in FIG. 6, the sensing unit senses and acquires voltage data of an OLED of a display panel or voltage data of a driving thin-film transistor of a sub-pixel of the display panel, and then sends the voltage data to an input register 215.

The input register 215 is configured to store the input voltage data temporarily. The input register sends the temporarily stored voltage data to an 8b/10b encoder 216.

The 8b/10b encoder 216, i.e., the first data converter, converts the 8-bit voltage data into 10-bit transmission data according to an encoding rule, and then sends the 10-bit transmission data to a parallel-to-serial converter 217.

The parallel-to-serial converter 217, i.e., the second data converter, converts the parallel transmission data into serial relay data, and then sends the serial relay data to the transmitter 213.

The transmitter 213 is configured to convert the relay data into differential data and send the differential data to the timing controller. The differential data are a highly noise resistant low-voltage differential signal and the relay data are a high-speed serial signal in a CMOS level.

Optionally, the 8b/10b encoder 216, the parallel-to-serial converter 217, and the transmitter 213 may be integrated in the sensing unit, or arranged separately, or partially integrated together.

Further, as shown in FIG. 7, the display panel further comprises a receiver 221, a clock data restorer 222, a third data converter 223, and a fourth data converter 224.

The receiver 221 is configured to receive the differential data and convert the differential data into the relay data; the clock data restorer 222 is configured to acquire the clock information from the relay data; the third data converter 223 is configured to convert the relay data into the transmission data according to the clock information; the fourth data converter 224 is configured to decode the transmission data into the voltage data according to the preset encoding rule, and the number of data bits of the transmission data is greater than that of the voltage data; and the timing controller 220 is further configured to receive the voltage data and perform voltage compensation on the sub-pixel or the OLED according to the voltage data.

As shown in FIG. 8, the receiver 221, the clock data restorer 222, the third data converter 223, and the fourth data converter 224 in this embodiment may be integrated in the timing controller. Of course, the receiver 221, the clock data restorer 222, the third data converter 223, and the fourth data converter 224 in this embodiment may be arranged separately, or partially integrated in the timing controller.

Specifically, as shown in FIG. 9, the receiver 221 receives the differential data in the foregoing embodiment and converts the differential data into serial relay data, wherein the differential data are a low-voltage differential signal and the relay data are a serial signal in a CMOS level. Then, the receiver 221 sends the relay data to the clock data restorer 222.

The clock data restorer 222 extracts the clock information from the serial relay data to complete an optimal sampling of the serial relay data. Then, the extracted clock information is sent to a serial-to-parallel converter 226.

The serial-to-parallel converter 226, i.e., the third data converter 223, converts the serial relay data into parallel transmission data according to the clock information, that is, converts the serial data into the parallel data by using the clock restored by the clock data restorer. Then, the parallel transmission data are sent to an 8b/10b decoder 227.

The 8b/10b decoder 227, i.e., the fourth data converter 224, decodes the parallel transmission data into 8-bit voltage data according to the preset encoding rule, that is, converts 10-bit data into 8-bit data. Then, the 8-bit voltage data is sent to an output register 228.

The output register 228 stores the 8-bit voltage data temporarily.

At last, the timing controller 220 performs voltage compensation on each sub-pixel according to the 8-bit voltage data by a preset algorithm. The stability of device performance is improved, and the stability of display of the OLED display panel is thus improved.

The receiver 221, the clock data restorer 222, the serial-to-parallel converter 226, the 8b/10b decoder 227, and the output register 228 in foregoing embodiment may be arranged separately, or integrated in the timing controller, or partially integrated in the timing controller.

Optionally, the sensing unit may be an independent element, for example, a sensing chip, which is mounted separately in the display panel.

Optionally, the OLED display panel further comprises a source driving chip; and the sensing unit is integrated in the source driving chip.

In some embodiments, the sensing unit comprises a plurality of sensing units which are connected in a cascaded manner. The data may be sequentially sent to the TCON.

It is to be noted that the use of 8B/10B encoding can ensure that there are enough signals to be converted in the data stream and that the number of "0" codes is the same as that of "1" codes, i.e., DC balanced, so that the PLL on the receiving side can operate correctly, and the loss of data caused by clock skew or loss of synchronization on the receiving side is avoided. Data with a large number of "0" or "1" are avoided, and an EMI interference is reduced.

Specifically, the 8-bit original data may be divided into two parts: low 5-bit EDCBA (set its decimal value as X) and high 3-bit HGF (set its decimal value as Y), then the 8-bit data may be expressed by D.X.Y.

12 control characters are further used in the 8b/10b encoding. Those control characters may be used as identifiers indicative of states such as a start of a frame, an end of a frame and an idle state. Similarly to the expression of data characters, the control characters are generally expressed by K.X.Y. There are 256 values for 8-bit data, and total 268 values if 12 control characters are counted.

There are 1024 values for 10-bit data, some of which may be selected to indicate the 8-bit data. In the selected codes, the number of 0 should be equal to the number of 1 as much as possible.

In 8b/10b encoding, K28.1, K28.5, and K28.7 are used as control characters of K code, referred to as "comma". In any data combination, comma appears only as a control character and will not appear in data load part. Therefore, the comma character may be used to indicate a start of a frame and an end of a frame, or to always correct a control character aligned with the data stream.

During the encoding, the low 5-bit original data EDCBA become a 6-bit code abcdei by 5B/6B encoding, the high 3-bit original data HGF become a 4-bit code fghj by 3B/4B encoding, and at last, these two parts are combined to form a 10-bit code abcdeifghj. During the transmission of the 10-bit code, the code is sent sequentially from low bits to high bits.

Upon receiving a sampling control signal from the TCON, the sensing unit starts to sense a voltage and converts the voltage into a digital format so as to obtain the sensed data.

The sensing unit sequentially sends signals, as differential signals such as LVDSs, to the TCON.

As shown in FIG. 10, a curve L5 denotes a sampling control signal and a curve L6 denotes differential data. The differential data may be in the LVDS format. Data in the LVDS format specifically comprises a transmission starting identifier (TS code), sensed data, a transmission ending identifier (TE code), and check data.

Transmission starting identifier (TS code): a control character used in the 8b/10b encoding is used as a data transmission starting identifier to start the transmission of the sensed data.

Sensed data: the sensed data subjected to the 8b/10b encoding will not be overlapped with the transmission starting identifier and the transmission ending identifier.

Transmission ending identifier (TE code): a control character used in the 8b/10b encoding is used as a data transmission ending identifier to present an end of the transmission of the sensed data.

As shown in FIG. 11, an embodiment of the present disclosure further provides a driving method for the OLED display panel. The driving method for the OLED display panel comprises steps S201 to S206.

Step S201: acquiring differential data sent by a sensing unit, the differential data comprising voltage data of a driving thin-film transistor of a sub-pixel or voltage data of an OLED.

Step S202: converting the differential data into serial relay data.

Step S203: acquiring clock information from the relay data.

Step S204: converting the relay data into parallel transmission data according to the clock information.

Step S205: decoding the transmission data into voltage data according to a preset encoding rule, the number of data bits of the transmission data being greater than that of the voltage data.

Step S206: performing voltage compensation on the sub-pixel or the OLED according to the voltage data.

This embodiment is realized by the timing controller alone, or by the cooperation of the timing controller and other elements. The fact that the timing controller only needs to receive the differential data and extract a clock signal from the differential data and does not need to receive a differential clock signal can eliminate the clock skew caused by impendence mismatching or the like. Both accuracy of data transmission and stability of data transmission are improved.

Further, before acquiring the differential data sent by the sensing unit, the driving method further comprises:

acquiring voltage data of a driving thin-film transistor of a sub-pixel or voltage data of an OLED;

encoding the voltage data into parallel transmission data according to the preset encoding rule, the number of data bits of the transmission data being greater than that of the voltage data;

converting the transmission data into serial relay data;

converting the relay data into differential data; and separately sending the differential data to a timing controller.

Optionally, the preset encoding rule may be an 8b/10b encoding rule.

It is to be noted that the use of 8B/10B encoding can ensure that there are enough signals to be converted in the data stream and that the number of "0" codes is the same as that of "1" codes, i.e., DC balanced, so that the PLL on the receiving side can operate correctly, and the loss of data caused by clock skew or loss of synchronization on the receiving side is avoided. Data with a large number of "0" or "1" are avoided, and an EMI interference is reduced.

Specifically, the 8-bit original data may be divided into two parts: low 5-bit EDCBA (set its decimal value as X) and high 3-bit HGF (set its decimal value as Y), then the 8-bit data may be expressed by D.X.Y.

12 control characters are further used in the 8b/10b encoding. Those control characters may be used as identifiers indicative of states such as a start of a frame, an end of a frame and an idle state. Similarly to the expression of data characters, the control characters are generally expressed by K.X.Y. There are 256 values for 8-bit data, and total 268 values if 12 control characters are counted.

There are 1024 values for 10-bit data, some of which may be selected to indicate the 8-bit data. In the selected codes, the number of 0 should be equal to the number of 1 as much as possible.

In 8b/10b encoding, K28.1, K28.5, and K28.7 are used as control characters of K code, referred to as "comma". In any data combination, comma appears only as a control character and will not appear in data load part. Therefore, the comma character may be used to indicate a start of a frame and an end of a frame, or to always correct a control character aligned with the data stream.

During the encoding, the low 5-bit original data EDCBA become a 6-bit code abcdei by 5B/6B encoding, the high 3-bit original data HGF become a 4-bit code fghj by 3B/4B encoding, and at last, these two parts are combined to form a 10-bit code abcdeifghj. During the transmission of the 10-bit code, the code is sent sequentially from low bits to high bits.

Upon receiving a sampling control signal from the TCON, the sensing unit starts to sense a voltage and converts the voltage into a digital format so as to obtain the sensed data.

The sensing unit sequentially sends signals, as differential signals such as LVDSs, to the TCON.

Data in the LVDS format specifically comprises a transmission starting identifier, sensed data, a transmission ending identifier, and check data. As shown in the figures, they are referred to as TS Code, Sensed data, TE Code, and check Data.

Transmission starting identifier (TS code): a control character used in the 8b/10b encoding is used as a data transmission starting identifier to start the transmission of the sensed data.

Sensed data: the sensed data subjected to the 8b/10b encoding will not be overlapped with the transmission starting identifier and the transmission ending identifier.

Transmission ending identifier (TE code): a control character used in the 8b/10b encoding is used as a data transmission ending identifier to present an end of the transmission of the sensed data.

It is to be noted that the use of 8B/10B encoding can ensure that there are enough signals to be converted in the data stream and that the number of "0" codes is the same as that of "1" codes, i.e., DC balanced, so that the PLL on the receiving side can operate correctly, and the loss of data caused by clock skew or loss of synchronization on the receiving side is avoided. Data with a large number of "0" or "1" are avoided, and an EMI interference is reduced.

Specifically, the 8-bit original data may be divided into two parts: low 5-bit EDCBA (set its decimal value as X) and high 3-bit HGF (set its decimal value as Y), then the 8-bit data may be expressed by D.X.Y.

12 control characters are further used in the 8b/10b encoding. Those control characters may be used as identifiers indicative of states such as a start of a frame, an end of a frame and an idle state. Similarly to the expression of data characters, the control characters are generally expressed by K.X.Y. There are 256 values for 8-bit data, and total 268 values if 12 control characters are counted.

There are 1024 values for 10-bit data, some of which may be selected to indicate the 8-bit data. In the selected codes, the number of 0 should be equal to the number of 1 as much as possible.

In 8b/10b encoding, K28.1, K28.5, and K28.7 are used as control characters of K code, referred to as "comma". In any data combination, comma appears only as a control character and will not appear in data load part. Therefore, the comma character may be used to indicate a start of a frame and an end of a frame, or to always correct a control character aligned with the data stream.

During the encoding, the low 5-bit original data EDCBA become a 6-bit code abcdei by 5B/6B encoding, the high 3-bit original data HGF become a 4-bit code fghj by 3B/4B encoding, and at last, these two parts are combined to form a 10-bit code abcdeifghj. During the transmission of the 10-bit code, the code is sent sequentially from low bits to high bits.

Upon receiving a sampling control signal from the TCON, the sensing unit starts to sense a voltage and converts the voltage into a digital format so as to obtain the sensed data.

The sensing unit sequentially sends signals, as differential signals such as LVDSs, to the TCON.

Data in the LVDS format specifically comprises a transmission starting identifier, sensed data, a transmission ending identifier, and check data. As shown in the figures, they are referred to as TS Code, Sensed data, TE Code, and check Data.

Transmission starting identifier (TS code): a control character used in the 8b/10b encoding is used as a data transmission starting identifier to start the transmission of the sensed data.

Sensed data: the sensed data subjected to the 8b/10b encoding will not be overlapped with the transmission starting identifier and the transmission ending identifier.

Transmission ending identifier (TE code): a control character used in the 8b/10b encoding is used as a data transmission ending identifier to present an end of the transmission of the sensed data.

Optionally, the OLED display panel further comprises a source driving chip; and the sensing unit is integrated in the source driving chip.

The sensing unit may comprise a plurality of sensing units which are connected in a cascaded manner. The data may be sequentially sent to the TCON.

In conclusion, although the present disclosure has been described with reference to the preferred embodiment thereof, it is apparent to those skilled in the art that a variety of modifications and changes may be made without departing from the scope of the present disclosure which is intended to be defined by the appended claims.

What is claimed is:

1. An OLED display panel, comprising:

a sensing unit configured to acquire voltage data of an OLED of the display panel or voltage data of a driving thin-film transistor of a sub-pixel of the display panel;

a first data converter configured to encode the voltage data into parallel transmission data according to a preset encoding rule, the number of data bits of the transmission data being greater than that of the voltage data;

a second data converter configured to convert the transmission data into serial relay data;

a transmitter configured to convert the relay data into differential data and send the differential data to a timing controller;

the timing controller configured to receive the differential data and extract clock information from the differential data, and perform voltage compensation on a sub-pixel or an OLED according to the differential data;

a receiver configured to receive the differential data and convert the differential data into the relay data;

a clock data restorer configured to acquire the clock information from the relay data;

a third data converter configured to convert the relay data into the transmission data according to the clock information; and a fourth data converter configured to decode the transmission data into the voltage data according to the preset encoding rule, the number of data bits of the transmission data being greater than that of the voltage data; wherein the timing controller is further configured to receive the voltage data and perform voltage compensation on the sub-pixel or the OLED according to the voltage data; wherein the sensing unit comprises a plurality of sensing units which are connected in a cascaded manner; the first data converter, the second data converter, and the transmitter are integrated in the sensing unit.

2. The OLED display panel as claimed in claim 1, wherein the sensing unit is an independent element.

3. The OLED display panel as claimed in claim 1, wherein the OLED display panel further comprises a source driving chip; and the sensing unit is integrated in the source driving chip.

4. The OLED display panel as claimed in claim 1, wherein the first data converter, the second data converter, and the transmitter are independent elements.

5. The OLED display panel as claimed in claim 1, wherein the first data converter is an 8b/10b encoder.

6. An OLED display panel, comprising:

a sensing unit configured to acquire voltage data of an OLED of the display panel or voltage data of a driving thin-film transistor of a sub-pixel of the display panel;

a first data converter configured to encode the voltage data into parallel transmission data according to a preset encoding rule, the number of data bits of the transmission data being greater than that of the voltage data;

a second data converter configured to convert the transmission data into serial relay data;

a transmitter configured to convert the relay data into differential data and send the differential data to a timing controller; and the timing controller configured to receive the differential data and extract clock information from the differential data, and perform voltage compensation on a sub-pixel or an OLED according to the differential data;

wherein the first data converter, the second data converter, and the transmitter are integrated in the sensing unit.

7. The OLED display panel as claimed in claim 6, wherein the display panel further comprises:

a receiver configured to receive the differential data and convert the differential data into the relay data;

a clock data restorer configured to acquire the clock information from the relay data;

a third data converter configured to convert the relay data into the transmission data according to the clock information;

a fourth data converter configured to decode the transmission data into the voltage data according to the preset encoding rule, the number of data bits of the transmission data being greater than that of the voltage data;

the timing controller further configured to receive the voltage data and perform voltage compensation on the sub-pixel or the OLED according to the voltage data.

8. The OLED display panel as claimed in claim 6, wherein the sensing unit is an independent element.

9. The OLED display panel as claimed in claim 6, wherein the OLED display panel further comprises a source driving chip; and the sensing unit is integrated in the source driving chip.

10. The OLED display panel as claimed in claim 6, wherein the sensing unit comprises a plurality of sensing units which are connected in a cascaded manner.

11. The OLED display panel as claimed in claim 6, wherein the first data converter, the second data converter, and the transmitter are independent elements.

12. The OLED display panel as claimed in claim 6, wherein the first data converter is an 8b/10b encoder.

* * * * *